US005337425A

United States Patent [19]

Hill

[11] Patent Number: 5,337,425

[45] Date of Patent: Aug. 16, 1994

[54] SHOWER CURTAIN

[76] Inventor: Jane Hill, 332 Gaynor La., Port Charlotte, Fla. 33953

[21] Appl. No.: 829,439

[22] Filed: Feb. 3, 1992

[51] Int. Cl.[5] ..... A47K 3/14

[52] U.S. Cl. ..... 4/610; 4/558; 4/608; 160/330; 160/369

[58] Field of Search ..... 4/557, 558, 607, 608, 4/610; 160/330, 345, 346, 368.1, 369

[56] References Cited

U.S. PATENT DOCUMENTS

| | | | |
|---|---|---|---|
| 2,761,150 | 9/1956 | Kellogg | 4/608 X |
| 2,897,514 | 8/1959 | Collins | 4/608 X |
| 3,235,926 | 2/1966 | Mates | 160/330 X |
| 3,251,399 | 5/1966 | Grossman | 160/368.1 X |
| 3,480,988 | 12/1969 | Miller et al. | 160/330 |
| 3,632,154 | 1/1972 | Woodrich | 4/608 X |
| 3,996,987 | 12/1976 | Rodriguez | 4/608 X |
| 4,088,174 | 5/1978 | Edwards | 4/608 X |
| 4,089,135 | 5/1978 | Beny et al. | 4/610 X |
| 4,115,899 | 9/1978 | Ford | 160/345 X |
| 4,152,790 | 5/1979 | Obradovits | 4/558 X |
| 4,333,187 | 6/1982 | Schuler | 4/608 |
| 4,667,353 | 5/1987 | Zeigler et al. | 4/610 X |
| 4,769,862 | 9/1988 | Skrzelowski | 4/610 |
| 4,972,896 | 11/1990 | Roberts | 160/368.1 X |
| 5,063,985 | 11/1991 | Bozzo | 160/330 |
| 5,090,095 | 2/1992 | Lightfoot | 160/330 X |
| 5,109,912 | 5/1992 | Gary | 160/330 |

FOREIGN PATENT DOCUMENTS

| | | | |
|---|---|---|---|
| 0267788 | 1/1969 | Fed. Rep. of Germany | 160/330 |
| 2232615 | 1/1973 | Fed. Rep. of Germany | 160/330 |
| 1162201 | 8/1969 | United Kingdom | 160/330 |

*Primary Examiner*—William A. Cuchlinski, Jr.
*Assistant Examiner*—John L. Beres
*Attorney, Agent, or Firm*—Michael I. Kroll

[57] ABSTRACT

An improved shower curtain for a shower enclosure of the type having a bathtub, a back wall and a side wall, the improved shower curtain including a first track bent in a U-shaped configuration, attachable to a back ledge, a free side ledge and a front ledge of the bathtub, the first track has a channel that is solely vertically C-shaped in cross section, a second track bent in a U-shaped configuration, spaced above the first track and attachable along one portion to the back wall, while its distal ends are attachable to the side wall, the second track has a channel that is solely vertically C-shaped in cross-section, an elongated sheet of flexible waterproof material sized to fit between and about the first track and the second track, a first unit for detachably securing a lower marginal edge of the sheet to the first track, the first detachably securing includes a plurality of spaced apart first fibrous fastener elements attached along the lower marginal edge of the sheet, a plurality of slide members that ride entirely within the solely vertical C-shaped channel of the first track, and a plurality of second fibrous fastener elements, each affixed to each of the slide members, so that the first fibrous fastener elements can detachably interlock with the second fibrous fastener elements, and a second unit for detachably securing an upper marginal edge of the sheet to the second track, the second detachably securing unit includes a plurality of spaced apart first fibrous fastener elements attached along the upper marginal edge of the sheet, a plurality of slide members that ride entirely within the solely vertical C-shaped channel of the second track, and a plurality of second fibrous fastener elements, each affixed to each of the slide members, so that the first fibrous fastener elements can detachably interlock with the second fibrous fastener elements, so that the sheet will be sealed thereto, to retain water within the shower enclosure.

1 Claim, 2 Drawing Sheets

SHOWER CURTAIN

BACKGROUND OF THE INVENTION

1. Field of the Invention

The instant invention relates generally to shower curtain guards and more specifically it relates to an improved shower curtain.

2. Description of the Prior Art

Numerous shower curtain guards have been provided in prior art that are adapted to hold the edges of the shower curtains to the shower walls and tubs to stop water leakage. While these units may be suitable for the particular purpose to which they address, they would not be as suitable for the purposes of the present invention as heretofore described.

SUMMARY OF THE INVENTION

A primary object of the present invention is to provide an improve shower curtain that will overcome the shortcomings of the prior art devices.

Another object is to provide an improved shower curtain that can be releasably secured to a wall and a portion of a bathtub ledge so that water will be retained behind the shower curtain.

An additional object is to provide an improved shower curtain that is easier to clean, is more sanitary, can be changed when needed and can be manufactured shorter and narrower.

A further object is to provide an improved shower curtain that is simple and easy to use.

A still further object is to provide an improved shower curtain that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
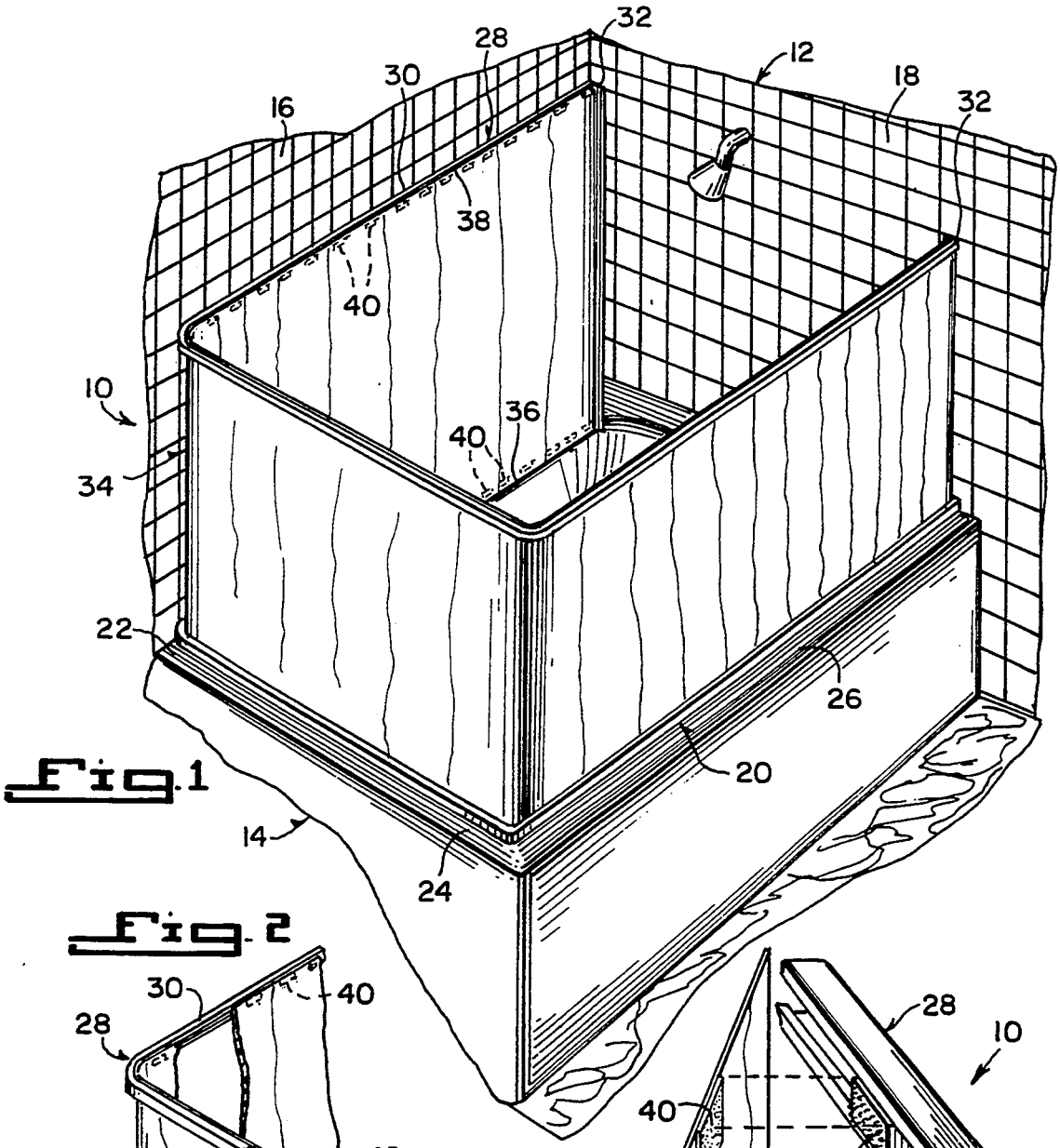
FIG. 1 is a perspective view of a first embodiment of the invention installed and ready to be used.
Figure 2:
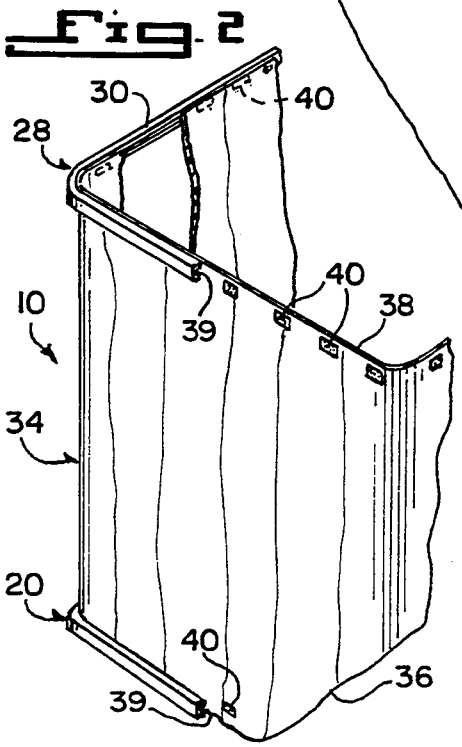
FIG. 2 is a perspective view of a portion of the shower curtain and tracks of the first embodiment.
Figure 3:
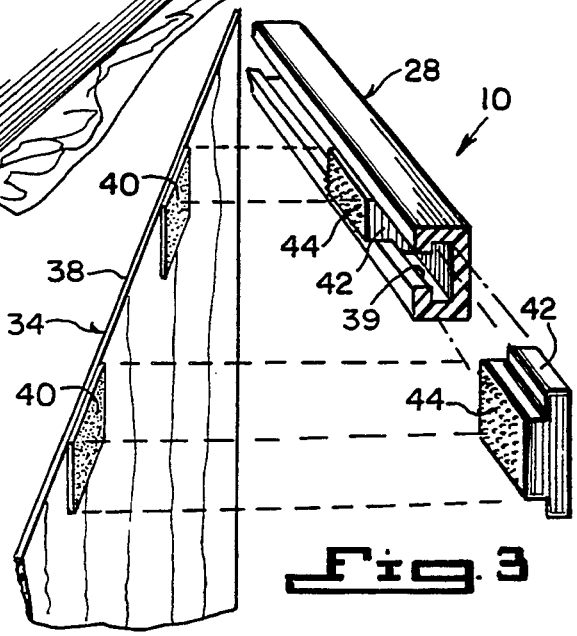
FIG. 3 is an exploded perspective view of a portion of the shower curtain and upper track of the first embodiment showing the VELCRO is greater detail.

Turning now descriptively to the drawings, in which similar reference characters denote similar elements throughout the several views, FIGS. 1 through 3 illustrate an improved shower curtain 10 for a shower enclosure 12 having a bathtub 14, a back wall 16 and a side wall 18. The improved shower curtain 10 consists of a first track 20 bent in a U-shaped configuration, attachable to a back ledge 22, a free side ledge 24 and a front ledge 26 of the bathtub 14. A second track 28 bent in a U-shaped configuration, is spaced above the first track 20 and is attachable along one portion 30 to the back wall 16, while its distal ends 32 are attachable to the side wall 18. An elongated sheet 34 of flexible waterproof material is sized to fit between and about the first track 20 and the second track 28. A lower marginal edge 36 of the sheet 34 is detachably secured to the first track 20, while an upper marginal edge 38 of the sheet 34 is detachably secured to the second track 28, so that the sheet 34 will be sealed thereto, to retain water within the shower enclosure 12.

The first tack 20 and the second track 28 each have a channel 39 that is solely vertically C-shaped in cross section. A plurality of spaced apart first fibrous fastener elements 40 are attached along the lower marginal edge 36 of the sheet 34. A plurality of slide members 42 ride within the solely vertically C-shaped channel 39 of the first track 20. A second fibrous fastener element 44 is affixed to each of the slide members 42, so that the first fibrous fastener elements 40 can detachably interlock with the second fibrous fastener elements 44.

A plurality of the spaced apart fibrous fastener elements 40 are also attached along the upper marginal edge 38 of the sheet 34. A plurality of the slide members 42 also ride within the solely vertically C-shaped channel 39 of the second track 28. A second fibrous fastener element 44 is also affixed to each of the slide members 42, so that the first fibrous fastener elements 40 can detachably interlock with the second fibrous fastener elements 44, as best seen in FIG. 3.

Figure 4:
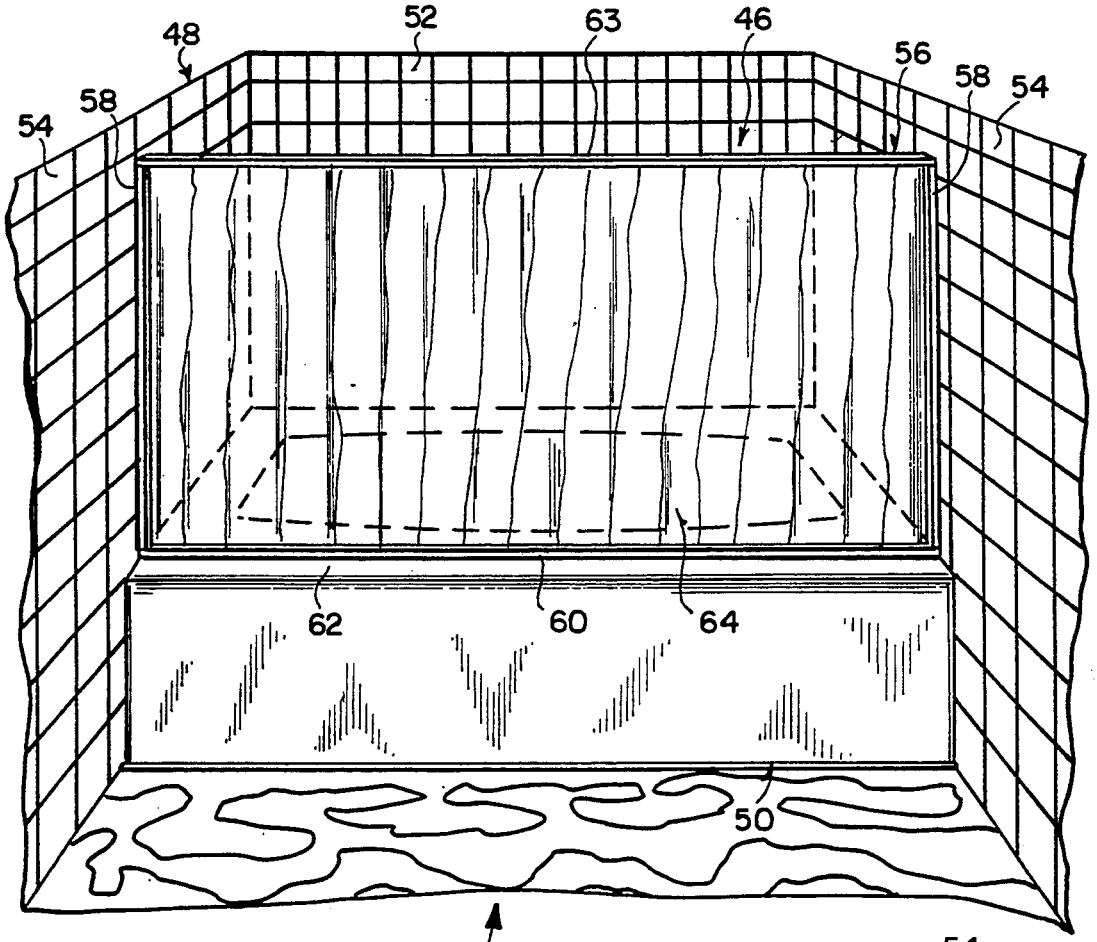
FIG. 4 is a perspective view of a second embodiment of the invention installed and ready to be used.
Figure 5:
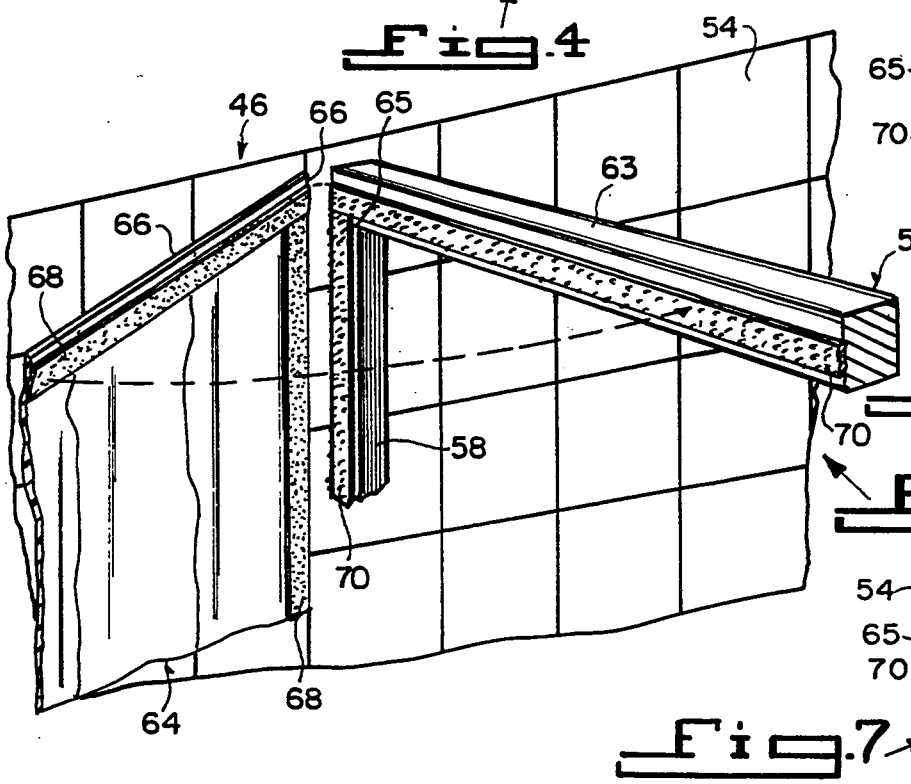
FIG. 5 is an exploded perspective view of a portion of the shower curtain and frame of the second embodiment showing the VELCRO in greater detail.

FIGS. 4 and 5 show another type of improved shower curtain 46 for a shower enclosure 48 having a bathtub 50, a back wall 52 and a pair of side walls 54. The improved shower curtain 46 consists of a frame 56 having a pair of vertical members 58, each attachable to one of the side walls 54, a lower horizontal member 60 attachable to a front ledge 62 of the bathtub 50 and an upper horizontal member 63 attachable to the top ends 65 of the pair of vertical members 58. An elongated sheet 64 of flexible waterproof material is sized to fit against the frame 56. The marginal edges 66 of the sheet 64 are detachably secured to the vertical members 58 and the horizontal members 60 and 63 of the frame 56, so that the sheet 64 will be sealed thereto, to retain water within the shower enclosure 48.

A first fibrous fastener element 68 is attached to the marginal edges 66 of the sheet 64. A second fibrous fastener element 70 is attached to the vertical members 58 and the horizontal members 60 and 63 of the frame 56, so that the first fibrous fastener element 68 can detachably interlock with the second fibrous fastener element 70.

Figure 6:
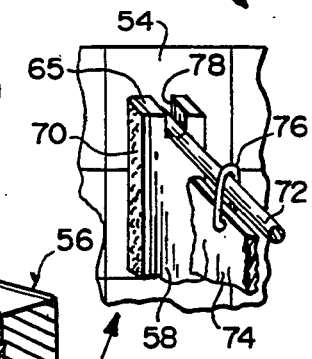
FIG. 6 is a perspective view of a portion of the frame of the second embodiment modified to receive and support a shower rod thereon.

As shown in FIG. 6, if a shower rob 72 and curtain 74 with hooks 76 are utilized, the first fibrous fastener element 68 along the upper marginal edge 66 of the sheet 64 and the upper horizontal member 63 with its respective second fibrous fastener element 70 are eliminated. Each vertical member 58 has a U-shaped recess 78 in the top end 65 to receive and support one end of the shower rod 72.

Figure 7:
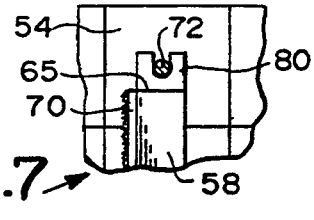
FIG. 7 is an elevational view of a portion of the frame of the second embodiment showing another type of structure to receive and support the shower rod.

As shown in FIG. 7, a U-shaped holder 80 can be affixed at the top end 65 of each vertical member 58, in place of the U-shaped recess 78, to receive and support one end of the shower rod 72.

The first fibrous fastener elements 40 and the second fibrous fastener elements 44 are well known as the trademark VELCRO. The first fibrous fastener element 68 and the second fibrous fastener element 70 are also well known as the trademark VELCRO.

LIST OF REFERENCE NUMBERS

10—improved shower curtain
12—shower enclosure
14—bathtub in 12
16—back wall in 12
18—side wall in 12
20—first track of 10
22—back ledge of 14
24—free side ledge of 14
26—front ledge of 14
28—second track of 10
30—portion of 28
32—distal end of 28
34—elongated sheet
36—lower marginal edge of 34
38—upper marginal edge of 34
40—first fibrous fastener element of 36 and 38
42—slide member in 20 and 28
44—second fibrous fastener element on 42
46—another improved shower curtain
48—shower enclosure
50—bathtub in 48
52—back wall in 48
54—side wall in 48
56—frame of 46
58—vertical member of 56
60—lower horizontal member of 56
62—front ledge of 50
63—upper horizontal member of 56
64—elongated sheet
65—top end of 58
66—marginal edges of 64
68—first fibrous fastener element at 66
70—second fibrous fastener element on 58
72—shower rod
74—shower curtain
76—hook
78—U-shaped recess in 65

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letter Patent is set forth in the appended claims:

1. An improved shower curtain for a shower enclosure of the type having a bathtub, a back wall and a side wall, said improved shower curtain comprising:

a) a first track bent in a U-shaped configuration, attachable to a back ledge, a free side ledge and a front ledge of the bathtub, said first track has a channel that is solely vertically C-shaped in cross section;

b) a second track bent in a U-shaped configuration, spaced above said first track and attachable along one portion to the back wall, while its distal ends are attachable to the side wall, said second track has a channel that is solely vertically C-shaped in cross-section;

c) an elongated sheet of flexible waterproof material sized to fit between and about said first track and said second track;

d) a first means for detachably securing a lower marginal edge of said sheet to said first track, said first detachably securing means includes a plurality of spaced apart first fibrous fastener elements attached along the lower marginal edge of said sheet, a plurality of slide members that ride entirely within said solely vertical C-shaped channel of said first track, and a plurality of second fibrous fastener elements, each affixed to each of said slide members, so that said first fibrous fastener elements can detachably interlock with said second fibrous fastener elements; and e) a second means for detachably securing an upper marginal edge of said sheet to said second track, said second detachably securing means includes a plurality of spaced apart first fibrous fastener elements attached along the upper marginal edge of said sheet, a plurality of slide members that ride entirely within said solely vertical C-shaped channel of said second track, and a plurality of second fibrous fastener elements, each affixed to each of said slide members, so that said first fibrous fastener elements can detachably interlock with said second fibrous fastener elements, so that said sheet will be sealed thereto, to retain water within the shower enclosure.

* * * * *